US009885347B2

(12) United States Patent
Lachey et al.

(10) Patent No.: US 9,885,347 B2
(45) Date of Patent: Feb. 6, 2018

(54) COMPONENTS FOR COMPRESSORS HAVING ELECTROLESS COATINGS ON WEAR SURFACES

(71) Applicant: EMERSON CLIMATE TECHNOLOGIES, INC., Sidney, OH (US)

(72) Inventors: Carl Joseph Lachey, Union, OH (US); Eric Anthony Maurer, Troy, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 183 days.

(21) Appl. No.: 14/527,484

(22) Filed: Oct. 29, 2014

(65) Prior Publication Data

US 2015/0118090 A1 Apr. 30, 2015

Related U.S. Application Data

(60) Provisional application No. 61/897,383, filed on Oct. 30, 2013.

(51) Int. Cl.
*F03C 2/00* (2006.01)
*F03C 4/00* (2006.01)
(Continued)

(52) U.S. Cl.
CPC ..... *F04B 1/00* (2013.01); *F04C 18/0215* (2013.01); *F04C 23/008* (2013.01);
(Continued)

(58) Field of Classification Search
CPC ..... F04C 18/0215; F04C 23/008; F04C 2230/91; F04C 2230/92; F04C 2210/261;
(Continued)

(56) References Cited

U.S. PATENT DOCUMENTS 2,532,283 A * 12/1950 Brenner ..... C23C 18/36 427/305
3,716,348 A * 2/1973 Perkins ..... B05D 5/083 205/196
(Continued)

FOREIGN PATENT DOCUMENTS

CN 1030814 A 2/1989
CN 1185539 A 6/1998
(Continued)

OTHER PUBLICATIONS

International Search Report regarding Application No. PCT/US2014/063124, dated Feb. 16, 2015.
(Continued)

*Primary Examiner* — Theresa Trieu
(74) *Attorney, Agent, or Firm* — Harness, Dickey & Pierce, P.L.C.

(57) ABSTRACT

Carbon dioxide compressors having one or more coatings with wear surfaces having electroless surface coatings are provided. Alternatively, propane compressors are contemplated having wear surface coatings. The coating is electrolessly applied and may comprise nickel and wear resistant particles, such as boron nitride. The electroless surface coatings for use with compressor machines improve corrosion and wear resistance, as well as anti-friction properties for compressors processing $CO_2$ or $C_3H_8$ containing refrigerants. In certain aspects, a scroll machine has an Oldham coupling and/or lower bearing comprising aluminum and has an electroless surface coating comprising nickel boron nitride particles disposed on one or more wear surfaces. In other aspects, a reciprocating compressor has a wear surface, such as on a connecting rod and/or piston coated with an electrolessly applied nickel and boron nitride particle layer.
(Continued)

Methods for making the electroless surface coatings are also provided.

21 Claims, 4 Drawing Sheets

(51) Int. Cl.
*F04C 2/00* (2006.01)
*F04B 1/00* (2006.01)
*F04C 23/00* (2006.01)
*F04C 18/02* (2006.01)

(52) U.S. Cl.
CPC .. *F04C 2210/261* (2013.01); *F04C 2210/266* (2013.01); *F04C 2230/91* (2013.01); *F04C 2270/16* (2013.01); *F05C 2201/021* (2013.01); *F05C 2201/0466* (2013.01); *F05C 2201/0484* (2013.01); *F05C 2251/10* (2013.01); *Y10T 428/1266* (2015.01); *Y10T 428/1275* (2015.01)

(58) Field of Classification Search
CPC ..... F04C 2210/266; F04C 2270/16; F04B 39/0246; F04B 1/00; F05C 2251/10; F05C 2201/021; F05C 2201/0466; F05C 2201/0484; Y10T 428/1266; Y10T 428/1275
USPC ..... 417/372; 418/55.1–55.6, 57, 178–179
See application file for complete search history.

(56) References Cited

U.S. PATENT DOCUMENTS 4,435,189 A * 3/1984 Bovenkerk ..... C23C 18/1635 427/217
4,480,698 A * 11/1984 Reeves ..... A01L 1/02 168/24
5,145,517 A * 9/1992 Feldstein ..... C23C 18/31 427/305
5,223,052 A 6/1993 Yamamoto et al.
5,246,786 A 9/1993 Usui
5,275,543 A 1/1994 Tanaka et al.
5,314,321 A 5/1994 Yamamoto et al.
5,320,506 A 6/1994 Fogt
5,382,144 A 1/1995 Tanaka et al.
5,468,130 A 11/1995 Yamada et al.
5,573,390 A * 11/1996 Takeuchi ..... F04C 2230/91 418/178
5,746,586 A 5/1998 Fukuhara et al.
5,755,898 A 5/1998 Yamamoto et al.
5,842,845 A 12/1998 Kawano et al.
5,897,965 A 4/1999 Itoh et al.
5,919,034 A 7/1999 Kawano et al.
5,931,651 A 8/1999 Kawano et al.
6,039,848 A 3/2000 Moslehi et al.
6,062,832 A 5/2000 Kawano et al.
6,132,192 A 10/2000 Mitsunaga et al.
6,142,755 A 11/2000 Shiinoki et al.
6,146,774 A 11/2000 Okamoto et al.
6,210,136 B1 4/2001 Kawano et al.
6,231,324 B1 5/2001 Clendenin et al.
6,254,755 B1 7/2001 Miura et al.
6,354,825 B1 * 3/2002 Fujiwara ..... F04C 2230/91 418/178
6,439,867 B1 8/2002 Clendenin
6,645,567 B2 11/2003 Chebiam et al.
6,908,504 B2 6/2005 Chebiam et al.
7,014,438 B2 3/2006 Fukuda et al.
7,028,601 B2 4/2006 Yoon et al.
7,264,453 B2 9/2007 Gennami et al.
7,371,059 B2 5/2008 Ignatiev et al.
7,377,035 B2 5/2008 Bin-Nun et al.
7,632,084 B2 12/2009 Sawai et al.
7,717,687 B2 5/2010 Reinhart
7,811,071 B2 10/2010 Fontaine et al.
7,896,629 B2 3/2011 Ignatiev et al.
8,075,957 B2 12/2011 Kim et al.
8,105,692 B2 * 1/2012 Dumm ..... B29C 33/56 428/408
8,356,987 B2 1/2013 Guo et al.
2003/0152467 A1 8/2003 Higashiyama et al.
2004/0202562 A1 * 10/2004 Grassbaugh ..... F04B 39/121 417/569
2009/0151525 A1 6/2009 Ed
2009/0297720 A1 12/2009 Ramgopal et al.
2011/0081264 A1 * 4/2011 Ishizono ..... F05C 2201/021 417/410.5
2011/0206532 A1 8/2011 Sorbo et al.
2012/0099970 A1 4/2012 Strock et al.
2012/0118722 A1 5/2012 Holtzapple et al.
2013/0143031 A1 6/2013 Sorbo et al.
2013/0167580 A1 7/2013 Ishida et al.
2013/0216720 A1 8/2013 Pearson et al.

FOREIGN PATENT DOCUMENTS

CN 101684809 A 3/2010
CN 201972923 U 9/2011
CN 102330683 A 1/2012
CN 202357051 U 8/2012
EP 0620286 A1 10/1994
EP 0941405 A2 9/1999
EP 2541065 A1 1/2013
JP H06159242 A 6/1994
JP H1137066 A 2/1999
JP 2001200328 A 7/2001
JP 2002031046 A 1/2002
JP 3475617 B2 12/2003
JP 2005155597 A 6/2005
JP 4332632 B2 9/2009

OTHER PUBLICATIONS

Written Opinion of the International Searching Authority regarding Application No. PCT/US2014/063124, dated Feb. 16, 2015.
Standard Specification for Autocatalytic Nickel Boron Coatings for Engineering Use, ASTM B607 91 2009 [online], [retrieved on Sep. 18, 2013], retrieved from http://www.astm.org/Standards/B607.htm.
Electroless Nickel Features Benefits and Applications, The Lindgren Group [online], [retrieved on Sep. 18, 2013].
Electroless Nickel Plating A Guide, Artistic Plating Company, Inc. [online], [retrieved on Sep. 18, 2013].
Electroless Nickel Plating, Chromplate Company [online], [retrieved on Sep. 18, 2013], retrieved from http://www.chromplate.com/electroless_nickel.html.
Electroless Nickel Plating A General Description of Electroless Nickel Plating and Its Effect on BAL TM Seal Performance in Reciprocating and Rotary Service Technical Report, Bal Seal Engineering, TR-16 Rev D Oct. 30, 2003 [online], [retrieved on Sep. 18, 2013], retrieved from (http://www.balseal.com/sites/default/files/tr16_020707131158.pdf.
Ch 07 Surface Preparation for Electroless Nickel Plating Hajdu 1990 [online], [retrieved on Sep. 18, 2013], retrieved from http://www2.bren.ucsb.edu/~dturney/port/papers/Electroless/07.pdf.
Electroless Plating, Szymanowski [online], [retrieved on Sep. 18, 2013], retrieved from http://www.corrosion-doctors.org/MetalCoatings/Electroless.htm.
Electroless Nickel, Erie Plating Company [online], [retrieved on Sep. 18, 2013], retrieved from http://erieplating.com/electroless-nickel.
Electroless Nickel Plating Instructions and Equipment, Brownells Walker, Jan. 2004 [online], [retrieved on Sep. 18, 2013], retrieved from http://www.brownells.com/userdocs/learn/Inst-109ElectrolessNickel.pdf.
Electroless Nickel Plating Tutorial, Caswell Inc. [online], [retrieved on Sep. 18, 2013], retrieved from www.caswellplating.com/electroless_tutorial.html.

(56) References Cited

OTHER PUBLICATIONS

Electroless Nickel Plating Nickel Boron Nitride and High Phosphorous Nickel, Erie Hard Chrome Inc. [online], [retrieved on Sep. 18, 2013], retrieved from www.eriehardchrome.com/electroless-nickel-plating.html#DetailedDescription.
Millenium KR Electroless Nickel Phosphorous Plating System, Erie Hard Chrome Inc. [online], [retrieved on Sep. 12, 2013], retrieved from www.eriehardchrome.com/millenium-kr.html.
What is Electroless Nickel? [online], [retrieved on Mar. 24, 2015], retrieved from http://newstar-chemicals.com/_pdf/Electroless%20Nickel%20Plating.pdf.
Office Action and Search Report regarding Chinese Patent Application No. 201480060278.6, dated Feb. 20, 2017. Translation provided by Unitalen Attorneys at Law.
Search Report regarding European Patent Application No. 14858020.2, dated Jul. 7, 2017.
Database WPI. Week 201028. Oct. 28, 2010. Thomson Scientific, London, GB. AN 2010-E52388.

* cited by examiner

COMPONENTS FOR COMPRESSORS HAVING ELECTROLESS COATINGS ON WEAR SURFACES

CROSS-REFERENCE TO RELATED APPLICATIONS

This application claims the benefit of U.S. Provisional Application No. 61/897,383 filed on Oct. 30, 2013. The entire disclosure of the above application is incorporated herein by reference.

FIELD

The present disclosure relates generally to compressor machines, including scroll-type and reciprocating compressor machines. More particularly, the present disclosure relates to compressors with anti-wear surfaces for use with carbon dioxide ($CO_2$) refrigerant or propane ($C_3H_8$) refrigerant.

BACKGROUND

This section provides background information related to the present disclosure which is not necessarily prior art.

Various refrigerants have been utilized in refrigeration systems that include a compressor machine, such as a scroll compressor or a reciprocating compressor. For example, halogenated hydrocarbon compounds have been widely used as refrigerants. Halogenated hydrocarbons tend to be stable, inert in their interaction with lubricants used in the compressor machine, and tend to have operating envelopes at moderate temperatures and pressures. However, halogenated hydrocarbons also have high global warming potential (a relative measure of how much heat a greenhouse gas traps in the atmosphere), so that these refrigerants have the potential to be environmentally detrimental if any leaks from refrigeration systems should occur.

In recent years, tightening environmental regulations have prompted significant interest and development in compressors and refrigeration systems that use refrigerants having low global warming potential. Thus, development of compressor designs that use natural or more environmentally-friendly refrigerants has been ongoing. One such refrigerant is carbon dioxide ($CO_2$ or R-744), which has a desirably low global warming potential of 1. Another is propane ($C_3H_8$ or R-290) having a global warming potential of less than about 4.

Compressors using carbon dioxide refrigerant typically require extremely high pressures (e.g., 30 to 200 atmospheres) and temperatures to operate in a refrigeration cycle. Compressors using $CO_2$ refrigerant may operate on a subcritical, transcritical or supercritical cycle under various operating conditions. In such operations, the $CO_2$ is particularly corrosive and may behave as a solvent or corrosive agent, penetrating and attaching a surface of a material or component inside the compressor causing undesirable reactions, resulting in corrosion, embrittlement, and the like. Propane can also behave as a solvent under certain conditions, thus causing similar issues, like corrosion. Further still, prevalent conventional refrigerants that contain halogens, particularly chlorides, tend to provide greater lubricity between parts. However, in the case of $CO_2$ or $C_3H_8$ as refrigerants, such benefits are absent. Moreover, hermetic compressor designs may pose particular design challenges, as they typically cannot be disassembled for regular maintenance of internal parts. Thus, failure or degradation of certain components can end a hermetic compressor's service life.

There is therefore a need for compressors that use carbon dioxide refrigerant, or alternatively propane, especially scroll compressors or reciprocating compressors, where the components exposed to refrigerant have greater wear and corrosion resistance, as well as improved anti-friction properties. Accordingly, the present disclosure is directed to a durable compressor machine and a reciprocating compressor which is designed to operate efficiently and to have improved wear and corrosion resistance when operated with the harsh operating conditions associated with a $CO_2$ refrigerant or alternatively $C_3H_8$ refrigerant.

SUMMARY

This section provides a general summary of the disclosure, and is not a comprehensive disclosure of its full scope or all of its features.

In certain aspects, the present disclosure provides wear surfaces that withstand operation in harsh compressor environments, where a refrigerant comprises carbon dioxide or propane. Therefore, in certain aspects, the present disclosure provides a compressor machine, which in certain variations, may be a scroll compressor or a reciprocating compressor. The compressor machine is configured to process a refrigerant comprising carbon dioxide and/or propane. In certain variations, the compressor machine comprises a component made from a material comprising aluminum. In certain aspects, the compressor component may be an Oldham coupling, a lower bearing, a connecting rod, a piston, a cylinder, and the like. The compressor component has at least one wear surface with an electroless surface coating comprising nickel. In certain variations, the electroless surface coating comprises a plurality of wear resistant particles, for example, selected from a group consisting of: boron nitride, silicon carbide, titanium carbonitride, titanium nitride, diamond, polytetrafluoroethylene, and combinations thereof. In certain preferred aspects, the wear resistant particle in the electroless surface coating comprises boron nitride, such as hexagonal boron nitride. The electroless surface coating has a superior hardness, for example, at greater than or equal to about 40 to less than or equal to about 63 on a Rockwell C Hardness Scale. Furthermore, the compressor component having the at least one wear surface with an electroless surface coating is robust and durable in the presence of the refrigerant, for example, being capable of use for at least 1,000 hours of compressor machine operation.

In certain other aspects, the present disclosure contemplates a scroll compressor machine. The scroll machine is configured to process a refrigerant selected from the group: carbon dioxide, propane, and combinations thereof. The scroll machine comprises a first scroll member having a discharge port and a first spiral wrap and a second scroll member having a second spiral wrap, the first and second spiral wraps being mutually intermeshed. The scroll machine further comprises a motor for causing the second scroll member to orbit with respect to the first scroll member. An Oldham coupling is keyed to the second scroll member and another component, such as the first scroll member, to prevent rotational movement of the second scroll member. The Oldham coupling comprises aluminum and has at least one wear surface comprising an electroless surface coating comprising nickel and wear resistant particles. In certain variations, the electroless surface coating comprises a plurality of wear resistant particles, for example, selected from a group consisting of: boron nitride, silicon carbide, titanium carbonitride, titanium nitride, diamond, polytetrafluoroethylene, and combinations thereof. In certain preferred aspects, the wear resistant particle in the electroless surface coating comprises boron nitride, such as hexagonal boron nitride. Such an Oldham coupling has corrosion and wear resistance when exposed to the refrigerant comprising carbon dioxide and/or propane in a scroll compressor machine, especially in a hermetic compressor.

In other aspects, a method of making an anti-friction coating for a wear surface of a compressor for use in a carbon dioxide compressor machine or alternatively a propane compressor machine is provided. In certain variations, the carbon dioxide compressor may be a scroll compressor or a reciprocating compressor. In other variations, the propane compressor may be a scroll compressor or a reciprocating compressor. The method comprises electrolessly coating at least one wear surface of an aluminum compressor component by contacting the at least one wear surface with an electroless bath comprising nickel, phosphorus, and optionally wear resistant particles, to form an electroless surface coating. The wear resistant particles may be selected from a group consisting of: boron nitride, silicon carbide, titanium carbonitride, titanium nitride, diamond, polytetrafluoroethylene, and combinations thereof. In certain preferred aspects, the wear resistant particle in the electroless surface coating comprises boron nitride, such as hexagonal boron nitride. In certain aspects, the electroless surface coating has a hardness of greater than or equal to about 40 to less than or equal to about 63 on a Rockwell C Hardness Scale. In various aspects, the aluminum compressor component having the at least one wear surface comprising the electroless surface coating is robust and durable in the presence of carbon dioxide refrigerant, for example, being capable of withstanding at least 1,000 hours of operation in a carbon dioxide compressor machine that processes a refrigerant comprising carbon dioxide. Similarly, the aluminum compressor component having the at least one wear surface comprising the electroless surface coating is also robust and durable in the presence of propane refrigerant in certain alternative variations, for example, being capable of withstanding at least 1,000 hours of operation in a propane compressor machine that processes a refrigerant comprising propane.

In certain aspects, the present disclosure provides wear surfaces that withstand operation in harsh compressor environments, where carbon dioxide is used as a refrigerant. Therefore, in certain aspects, the present disclosure provides a carbon dioxide compressor machine, which in certain variations, may be a scroll compressor or a reciprocating compressor. The carbon dioxide compressor machine is configured to process a refrigerant comprising carbon dioxide. In certain variations, the carbon dioxide compressor machine comprises a component made from a material comprising aluminum. In certain aspects, the compressor component may be an Oldham coupling, a lower bearing, a connecting rod, a piston, a cylinder, and the like. The compressor component has at least one wear surface with an electroless surface coating comprising nickel. In certain variations, the electroless surface coating comprises a plurality of wear resistant particles, for example, selected from a group consisting of: boron nitride, silicon carbide, titanium carbonitride, titanium nitride, diamond, polytetrafluoroethylene, and combinations thereof. In certain preferred aspects, the wear resistant particle in the electroless surface coating comprises boron nitride, such as hexagonal boron nitride. The electroless surface coating has a superior hardness, for example, at greater than or equal to about 40 to less than or equal to about 63 on a Rockwell C Hardness Scale. Furthermore, the compressor component having the at least one wear surface with an electroless surface coating is robust and durable in the presence of carbon dioxide refrigerant, for example, being capable of use for at least 1,000 hours of carbon dioxide compressor machine operation.

In certain alternative aspects, the present disclosure provides a propane compressor machine, which in certain variations, may be a scroll compressor or a reciprocating compressor. The propane compressor machine is configured to process a refrigerant comprising propane. In certain variations, the propane compressor machine comprises a component made from a material comprising aluminum. In certain aspects, the compressor component may be an Oldham coupling, a lower bearing, a connecting rod, a piston, a cylinder, and the like. The compressor component has at least one wear surface with an electroless surface coating comprising nickel. In certain variations, the electroless surface coating comprises a plurality of wear resistant particles, for example, selected from a group consisting of: boron nitride, silicon carbide, titanium carbonitride, titanium nitride, diamond, polytetrafluoroethylene, and combinations thereof. In certain preferred aspects, the wear resistant particle in the electroless surface coating comprises boron nitride, such as hexagonal boron nitride. The electroless surface coating has a superior hardness, for example, at greater than or equal to about 40 to less than or equal to about 63 on a Rockwell C Hardness Scale. Furthermore, the compressor component having the at least one wear surface with an electroless surface coating is robust and durable in the presence of propane refrigerant, for example, being capable of use for at least 1,000 hours of propane compressor machine operation.

Further areas of applicability of the present disclosure will become apparent from the detailed description provided hereinafter. It should be understood however that the detailed description and specific examples, while indicating preferred embodiments of the disclosure, are intended for purposes of illustration only, since various changes and modifications within the spirit and scope of the disclosure will become apparent to those skilled in the art from this detailed description.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
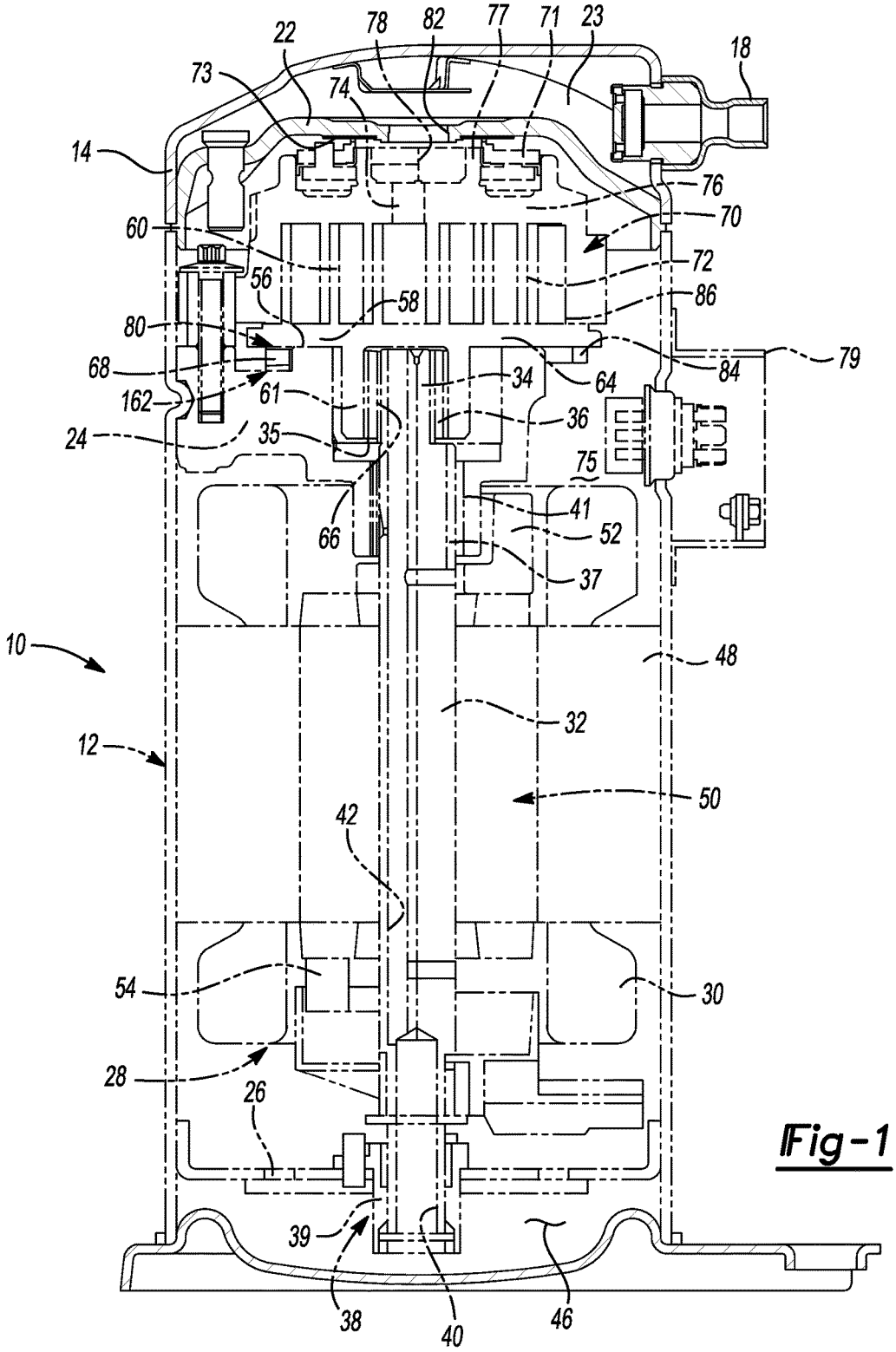
FIG. 1 is a vertical sectional view through the center of an exemplary scroll compressor.

Example embodiments will now be described more fully with reference to the accompanying drawings.

Such example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters.

In addition, disclosure of ranges includes disclosure of all values and further divided ranges within the entire range, including endpoints and sub-ranges given for the ranges.

In various aspects, the present teachings pertain to improved, robust wear surfaces on components for use in compressor machines that use carbon dioxide as a refrigerant. As noted above, particular technical challenges are encountered in compressors that use carbon dioxide refrigerant. For example, carbon dioxide fails to provide lubricating properties that were provided by conventional chloride-based refrigerants. This causes much more significant wear on moving parts in the compressor. Furthermore, carbon dioxide is especially problematic as a refrigerant, because it behaves as a solvent and corrosive agent, especially at the high temperatures and pressures often employed in refrigeration compressors. Thus, finding suitable materials that can withstand such conditions is particularly difficult. This is especially an issue for compressor components that have wear surfaces, where contact occurs against one or more opposing counter-surfaces. Thus, many conventional anti-wear materials suitable for use with conventional halogen-containing refrigerants have been observed to be wholly unsuitable in the extreme and harsh conditions attendant with carbon dioxide refrigerant.

Notably, in certain alternative embodiments, a component for use in compressor machines that uses propane as a refrigerant is also provided. Propane also can behave as a solvent, even at subcritical temperatures and pressures. Thus, like carbon dioxide, propane has the potential to be a corrosive agent that attacks certain compressor components when used as a refrigerant. Hence, principles according to certain aspects of the present teachings may be also be used in conjunction with compressor components for use in a propane refrigerant compressor.

In certain compressors, conventional ferrous-based or aluminum-based metal materials components are particularly susceptible to failure in a carbon dioxide (or a propane)

refrigerant environment. For example, in a scroll compressor, an Oldham coupling is typically keyed to both scroll members and sits upon a main bearing housing thrust surface to prevent rotational movement of an orbiting scroll. The Oldham coupling should be durable, lightweight, and have good anti-wear properties as it interacts with various counter-surfaces. However, in certain scroll compressors, such as those that use carbon dioxide refrigerant, it has been observed that Oldham couplings formed of conventional ferrous-based or aluminum-based metal materials are especially prone to corrosion and can prematurely degrade and fail upon prolonged exposure to carbon dioxide. As noted above, under certain conditions, propane can be similarly corrosive to Oldham couplings in compressors. Moreover, as the Oldham coupling degrades in such an environment, particulate and debris can be generated. This debris not only impacts service life of the Oldham coupling, but also can contaminate certain bearings within the compressor and thus cause failure of the compressor. This is particularly an issue in hermetic scroll compressors, which require long-term durability of all internal components hermetically sealed in the housing shell, because maintenance and replacement of Oldham couplings or other components, like bearings, is typically not an option.

The present disclosure provides wear surfaces on compressor components that are capable of withstanding harsh conditions that coincide with use of carbon dioxide as a refrigerant. Therefore, in certain aspects, the present disclosure provides a carbon dioxide compressor machine, which in certain variations, may be a scroll compressor or a reciprocating compressor. In certain variations, the carbon dioxide compressor machine comprises a component comprising a metal material, such as aluminum (e.g., aluminum alloys). In certain aspects, the compressor component may be an Oldham coupling, a lower bearing, a connecting rod, a piston, a cylinder, and the like. In various aspects of the inventive technology, at least one wear surface of the compressor component has an electroless surface coating comprising nickel. By "electroless surface coating," it is meant that the coating is applied to a surface of the component in an electroless process without use of an applied voltage or potential during the deposition. Electroless plating refers to a chemically applied metal material coating, where the depositing of the metal material is accomplished via autocatalytic reaction, rather than by presence of an electrical current or potential. The electroless deposition process provides a highly controlled, uniform density coating with excellent surface coverage, especially as compared to electrolytically deposited coatings. Electrolytic deposition processes can vary in density and coverage of a deposited coating, especially for parts having complex shapes, because establishing even current density over the complex contours of the part can be difficult. In a carbon dioxide or propane environment, uneven weak coatings can result in potential corrosion initiation sites, for example. Moreover, in various aspects, the electroless surface coating has a high surface hardness level.

In certain variations, in addition to nickel, the electroless surface coating further comprises a wear resistant particle selected from a group consisting of: boron nitride, silicon carbide, titanium carbonitride, titanium nitride, diamond, polytetrafluoroethylene, and combinations thereof. A plurality of such wear resistant particles can be co-deposited with the metal material during electroless deposition, thus forming a substantially homogenous distribution of occluded particles in the nickel matrix. For example, in certain preferred variations, the electroless surface coating optionally further comprises a boron nitride particle. Suitable boron nitride particles include hexagonal boron nitride or in alternative variations, cubic boron nitride.

In other alternative variations, the present disclosure provides wear surfaces on compressor components that are capable of withstanding harsh conditions that coincide with use of propane as a refrigerant. Therefore, in certain aspects, the present disclosure provides a propane compressor machine, which in certain variations, may be a scroll compressor or a reciprocating compressor. In certain variations, the propane compressor machine comprises a component comprising a metal material, such as aluminum (e.g., aluminum alloys). In certain aspects, the compressor component may be an Oldham coupling, a lower bearing, a connecting rod, a piston, a cylinder, and the like. In various aspects of the inventive technology, at least one wear surface of the compressor component has an electroless surface coating comprising nickel and optionally a wear resistant particle, as described above.

In certain aspects, the present disclosure provides methods of making an anti-friction coating for a wear surface of a carbon dioxide compressor machine component. In alternative aspects, the present disclosure provides methods of making an anti-friction coating for a wear surface of a propane compressor machine component. The method may comprise electrolessly coating at least one wear surface of a compressor component by contacting the at least one wear surface with an electroless bath. Electroless deposition is typically conducted by contacting the surface to be coated with a bath or solution/suspension, such as an aqueous bath comprising a solution or suspension containing metal ions, a reducing agent, complexing and buffering agents and stabilizers, such that chemical reactions on the surface of a substrate result in deposition. Thus, the at least one wear surface is contacted with a bath comprising nickel, phosphorus, and wear resistant particles, such as boron nitride particles, to form an electroless surface coating.

Nickel is particularly suitable as a metal used in electroless deposition. Notably, in accordance with the present disclosure, one or more particle species may also be present in the bath or suspension and are co-deposited along with metal ions. As noted above, the contacting of the wear surface with the electroless bath components occurs in the absence of applied voltage or current. In various aspects, the electroless surface coating thus formed has a matrix comprising nickel with a plurality of wear resistant particles, such as boron nitride particles, distributed or occluded therein. Such an electroless surface coating has an even density and thickness. The presence of the occluded boron nitride particles in the matrix provides lower coefficients of friction, thus the electroless surface coating has good lubricity and anti-wear benefits, excellent hardness, wear resistance, is inert and exhibits corrosion resistance and stability in the presence of carbon dioxide refrigerant. As will be described in greater detail below, in certain aspects, the compressor component having at least one wear surface comprising the electroless surface coating is capable of withstanding at least 1,000 hours of operation in a carbon dioxide compressor machine that processes a refrigerant comprising carbon dioxide. Such performance is particularly desirable in a hermetic compressor.

In alternative aspects, the electroless surface coating has good lubricity and anti-wear benefits, excellent hardness, wear resistance, is inert and exhibits corrosion resistance and stability in the presence of propane refrigerant. As will be described in greater detail below, in certain aspects, the compressor component having at least one wear surface comprising the electroless surface coating is capable of withstanding at least 1,000 hours of operation in a propane compressor machine that processes a refrigerant comprising propane, which is particularly desirable in a hermetic compressor.

Figure 5:
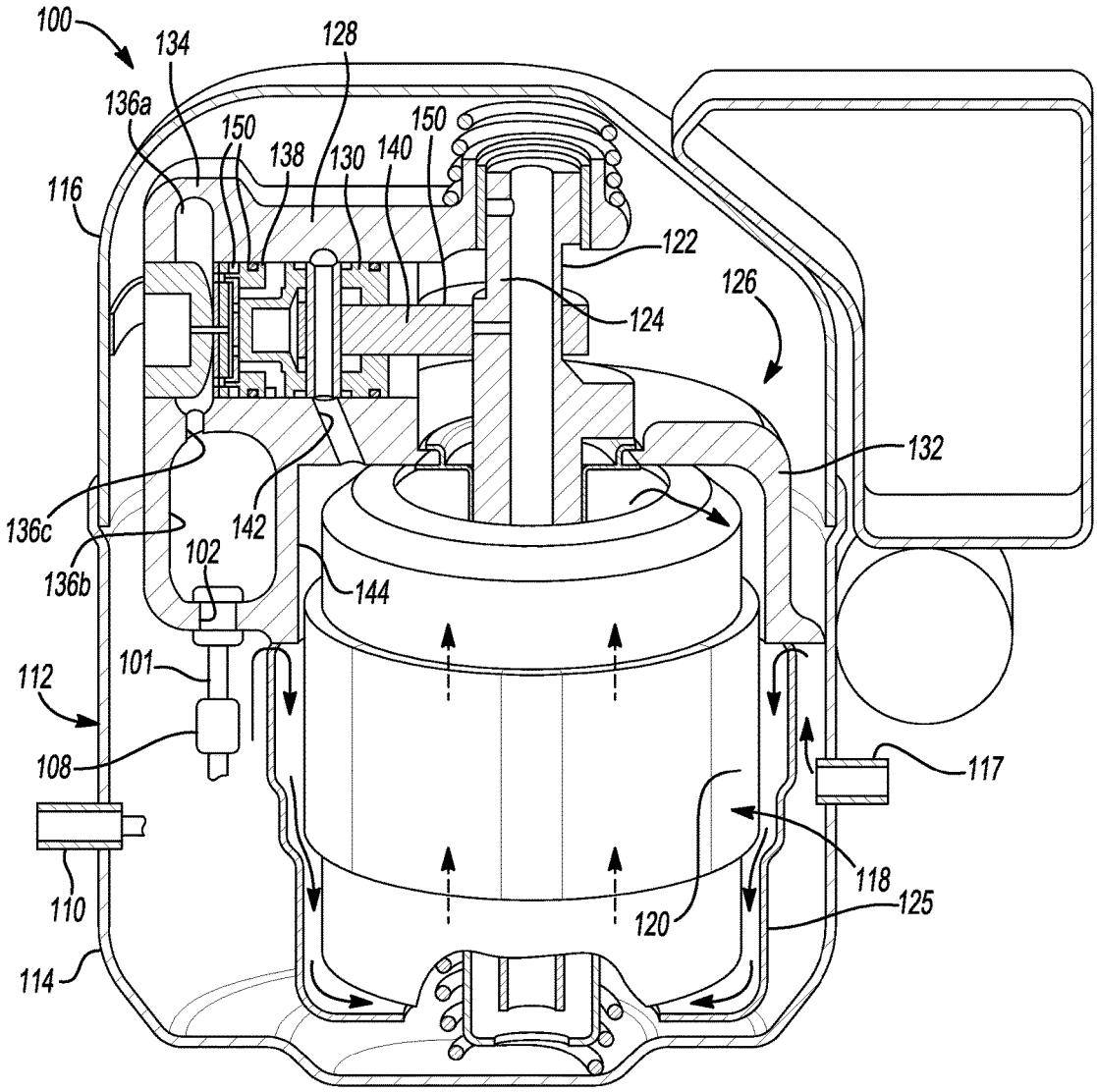
FIG. 5 is a partial cross-sectional perspective view of a reciprocating compressor according to the principles of the present disclosure.

While the principles of the present disclosure are suitable for incorporation with many different types of compressor machines that use a refrigerant that comprises carbon dioxide, such electroless surface coatings are particularly useful with scroll compressor and reciprocating compressors. In particular, for exemplary purposes, an exemplary scroll compressor machine that processes a refrigerant comprising carbon dioxide ($CO_2$) is illustrated in FIG. 1, while an exemplary reciprocating machine that processes a refrigerant comprising carbon dioxide ($CO_2$) is illustrated in FIG. 5.

Referring now to the drawings and in particular to FIG. 1, a $CO_2$ refrigerant compressor 10 is shown which includes a generally cylindrical hermetic shell 12 having welded at the upper end thereof a cap 14. Cap 14 is provided with a refrigerant discharge fitting 18, which may have the usual discharge valve therein. Other major elements affixed to the shell include an inlet fitting (not shown), a transversely extending partition 22 that is welded about its periphery at the same point that cap 14 is welded to shell 12. A discharge chamber 23 is defined by cap 14 and partition 22. A two-piece main bearing housing 24 and a lower bearing support 26 having a pair of radially outwardly extending legs are each secured to the shell 12. A motor 28 including a motor stator 30 is disposed between the main bearing housing 24 and lower bearing support 26. A crank shaft 32 having an eccentric crank pin 34 at the upper end thereof is rotatably journaled in a drive bushing 36 adjacent an upper bearing 35 disposed in a cylindrical hub 61 of an orbiting scroll 58 and a lower bearing assembly 38 in lower bearing support 26. The crank shaft 32 passes through and rotates within an aperture 41 of main bearing housing 24, which may include a cylindrical main bearing member 37 within aperture 41.

Figure 3:
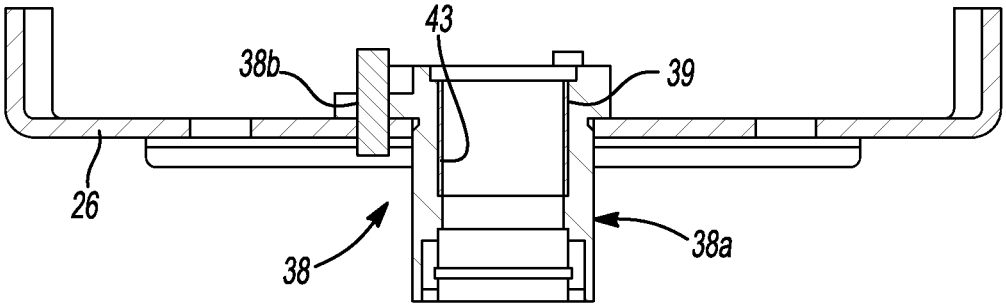
FIG. 3 is a cross-sectional view showing a lower bearing assembly according to certain principles of the present disclosure.
Figure 4:
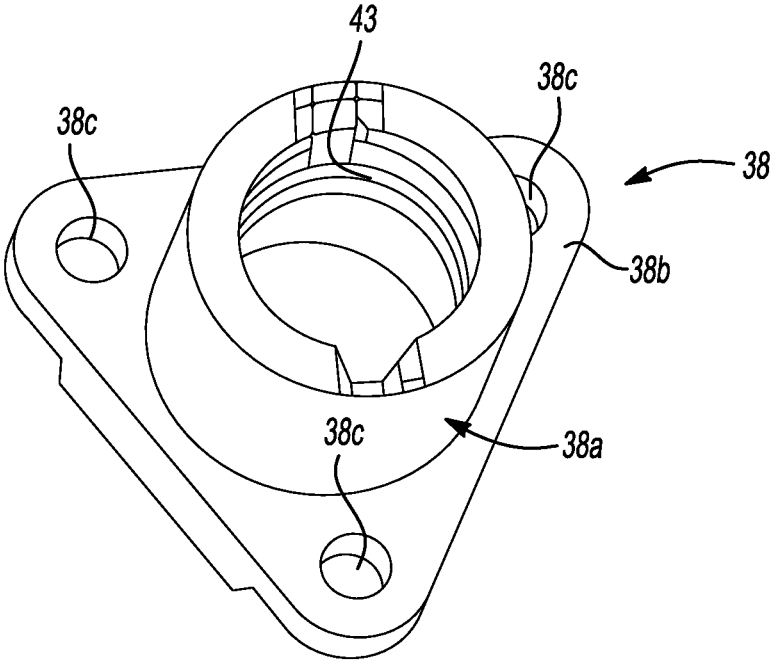
FIG. 4 is a perspective view of the lower bearing according to certain principles of the present disclosure.

In various aspects, the lower bearing assembly 38 receives a terminal end of crank shaft 32 and thus defines a wear surface 43. As best illustrated in FIGS. 3 and 4, the lower bearing assembly 38 includes a bearing housing 38*a* having a cylindrical opening extending there through and a radially extending flange portion 38*b* having a plurality of mounting openings 38*c* therein that allow the bearing housing 38*a* to be mounted to the lower bearing support 26. The cylindrical lower bearing member 39 is received in the bearing housing 38*a* and defines wear surface 43 disposed directly against the crank shaft 32.

With renewed reference to FIG. 1, crank shaft 32 has at the lower end, a relatively large diameter concentric bore 40 which communicates with a radially outwardly smaller diameter bore 42 extending upwardly therefrom from the top of crank shaft 32. The lower portion of the interior shell 12 defines an oil sump 46, which is filled with lubricating oil. Lubricating oils acceptable for use with the $CO_2$ refrigerant generally include synthetic polyolesters formed from esterification of acid with alcohol. By way of example, one suitable carbon dioxide refrigerant compatible polyolester lubricating oil is commercially available from CPI Engineering Services, Inc. under the tradename EMKARATE™ RL 68HB or ES32-94. Another suitable carbon dioxide compatible polyolester oil is available under the product name RENISO™ C85 E sold by Fuchs. Bore 40 acts as a pump to force lubricating fluid up the crank shaft 32 and into bore 42 and ultimately to all of the various portions of the compressor which require lubrication. Crank shaft 32 is rotatably driven by electric motor 28 including motor stator 30, windings 48 passing therethrough, and a motor rotor 50 press fitted on crank shaft 32 and having upper and lower counterweights 52 and 54, respectively.

The upper surface of the main bearing housing 24 is provided with a flat thrust bearing surface 56 on which is disposed orbiting scroll 58 having the usual spiral vane or orbiting scroll wrap 60 on the upper surface thereof. Projecting downwardly from the lower surface of orbiting scroll 58 is the cylindrical hub 61 having a self-lubricating upper bearing 35 which receives the drive bushing 36 therein which has an inner bore 66 in which crank pin 34 is drivingly disposed. Crank pin 34 has a flat on one surface which drivingly engages a flat surface (not shown) formed in a portion of bore 66 to provide a radially compliant driving arrangement, such as shown in U.S. Pat. No. 4,877,382, the disclosure of which is hereby incorporated herein by reference. A floating seal 71 is supported by a non-orbiting scroll 70 and engages a seat portion 73 mounted to the partition 22 for sealingly dividing the intake 75 and discharge 23 chambers.

Non-orbiting scroll member 70 is provided having a non-orbiting scroll wrap 72 member positioned in meshing engagement with orbiting scroll wrap 60 of orbiting scroll 58. Non-orbiting scroll 70 has a centrally disposed discharge passage 74 defined by a base plate portion 76. Non-orbiting scroll 70 also includes an annular hub portion 77 which surrounds the discharge passage 74. A reed valve assembly 78 or other known valve assembly is provided in the discharge passage 74.

Figure 2A:
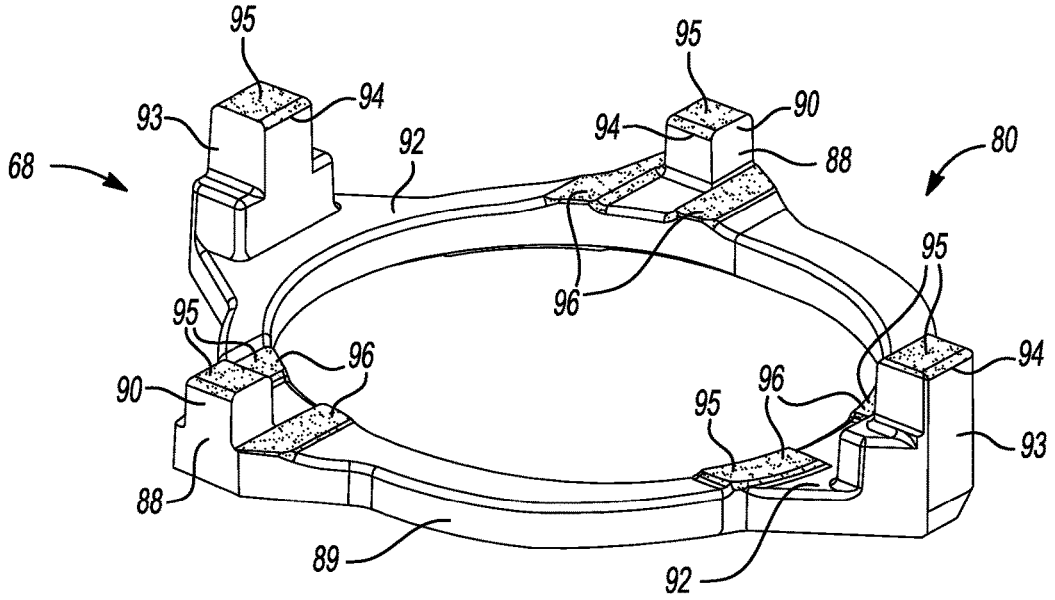
FIG. 2A is a perspective view of an Oldham coupling ring from a first side prepared in accordance with certain principles of the present disclosure.
Figure 2B:
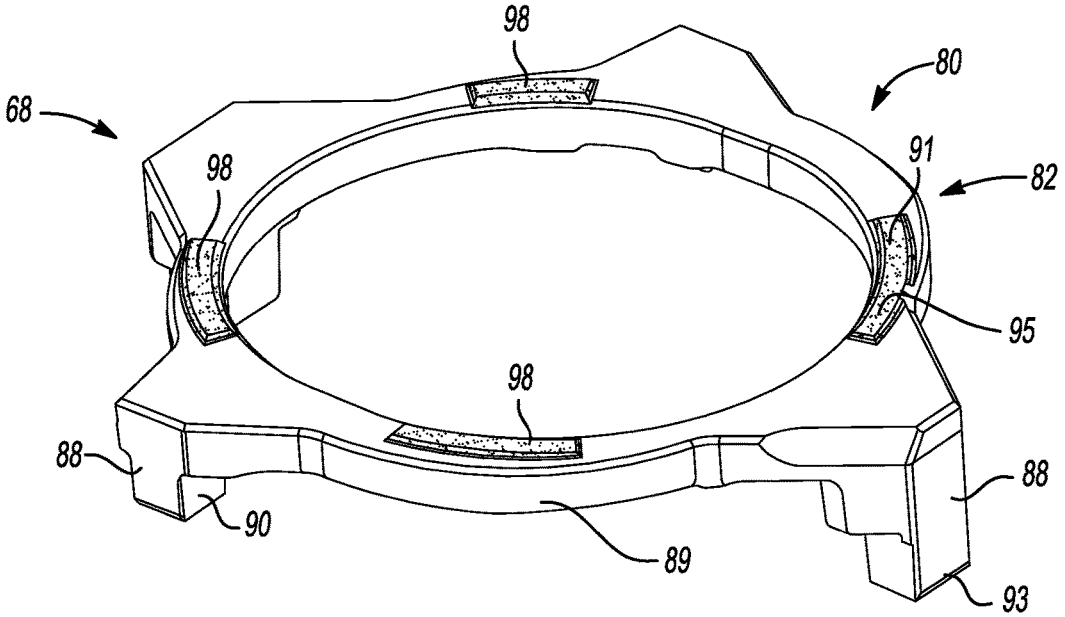
FIG. 2B is a perspective view from a second side opposite to the first side shown in FIG. 2A prepared in accordance with certain principles of the present disclosure.

An Oldham coupling 68 is disposed between orbiting scroll 58 and bearing housing 24. Oldham coupling 68 is keyed to orbiting scroll 58 and non-orbiting scroll 70 to prevent rotational movement of orbiting scroll 58. Oldham coupling 68, as shown in FIGS. 2A and 2B, can be of the type disclosed in assignee's U.S. Pat. No. 5,320,506, the entire disclosure of which is hereby incorporated herein by reference. As discussed above, such Oldham coupling 68 components experience particularly harsh conditions in a compressor, as they are continually subjected to refrigerant materials, high temperatures, and high physical stresses, particularly torsional stress, and are thus formed of wear-resistant materials that have strength sufficient to withstand fatigue and stress in such an environment.

In certain other aspects, the present disclosure contemplates a scroll compressor 10 machine configured to process a refrigerant comprising carbon dioxide. The scroll machine 10 comprises a first scroll member 70 having a discharge port or passage 74 and non-orbiting scroll wrap 72 and a second orbiting scroll 58 member having a second orbiting spiral wrap 60, the first non-orbiting and second orbiting spiral wraps 72, 60 being mutually intermeshed. The scroll compressor 10 further comprises the motor 118 for causing the second orbiting scroll 58 to orbit with respect to the first non-orbiting scroll wrap 72. As the second orbiting scroll 58 orbits with respect to the first non-orbiting scroll 70, the non-orbiting and orbiting wraps 72, 60 create at least one enclosed space of progressively changing volume between a peripheral suction zone (e.g., corresponding to intake chamber 75) defined by the scroll members and the discharge port or passage 74. An Oldham coupling 68 is keyed to the second orbiting scroll 58 and the first scroll member 70 to prevent rotational movement of the second orbiting scroll 58. The Oldham coupling 68 comprises aluminum and has at least one wear surface comprising an electroless surface coating comprising nickel and boron nitride particles, as described herein.

FIGS. 2A and 2B show a detailed Oldham coupling 68 (assembled into the scroll compressor 10 in FIG. 1). A first side 80 is shown in FIG. 2A, while an opposite second side 82 of the Oldham coupling 68 is shown in FIG. 2B. As discussed above, the Oldham coupling 68 is keyed to orbiting scroll 58 and to non-orbiting scroll 70 to prevent rotational movement of orbiting scroll 58 as it is driven by crank shaft 32.

A plurality of Oldham keys 88 is provided on Oldham coupling ring 89. A first pair of keys 90 is in a generally diametrically aligned relationship and each projects upward from a surface 92 of Oldham coupling ring 89. A second pair of keys 93 is likewise aligned diametrically apart on the Oldham coupling ring 89 and also projects upward from surface 92. The second pair of keys 93 generally extends farther upwards, so that the second pair of keys is capable of engaging with non-orbiting scroll 70. The first pair of keys 90 is shorter and thus is capable of engaging with the orbiting scroll 58. Oldham coupling 68 is guided in its translational movement by non-orbiting scroll keys 93 while being driven by orbiting scroll keys 90.

A base plate portion 64 of orbiting scroll 58 has a pair of outwardly projecting flange portions 84 each of which defines an outwardly opening slot sized to slidingly receive the first pair of Oldham keys 90. Likewise, base plate portion 76 of fixed non-orbiting scroll 70 is provided with a pair of outwardly projecting flange portions 86, each of which defines an outwardly opening slot. Slots are sized to slidingly receive the second pair of Oldham keys 93. The keys 90 and 93 have an axial length or height to engage with the respective scrolls 58, 70, while avoiding projecting so far as to impede movement or operation of other components. Generally, vertical motion of Oldham coupling 68 is limited by contact of a plurality of Oldham pads 91 disposed on the second side 82 of Oldham coupling ring 89. As Oldham coupling 68 is driven, inertial and frictional forces tend to cause the plurality of Oldham pads 91 to contact the one or more Oldham coupling receiving surfaces of the main bearing housing 24.

Thus, a first plurality of Oldham coupling wear surfaces 94 is formed on the contact regions at the terminal end of each Oldham key 88 (whether in the first pair of keys 90 or second pair of keys 93). A second plurality of Oldham coupling wear surfaces 96 is raised and forms discrete contact regions along the first side 80 of the Oldham coupling ring 89 in a region near or adjacent to the Oldham keys 88. A third plurality of Oldham coupling wear surfaces 98 is formed on the contact regions at the terminal end of each Oldham pad 91 along the second side 82 of Oldham coupling ring 89.

In various aspects, one or more portions of the Oldham coupling 68 comprise a metal material that is compatible with a refrigerant comprising carbon dioxide, meaning the material(s) does not suffer from excessive physical or chemical degradation in the presence of carbon dioxide to fail prematurely. Further, materials selected for use in the Oldham coupling 68 have a suitable abrasion resistance, wear resistance, and strength to withstand the operating conditions in the scroll machine.

In certain aspects, the Oldham coupling 68 metal material comprises aluminum, such as aluminum alloys. The materials of the Oldham coupling 68 may be wrought, cast, or sintered in a conventional manner as recognized in the art. It should be understood that aluminum may be alloyed with other common alloying elements, including silicon (Si), copper (Cu), magnesium (Mg), iron (Fe), manganese (Mn), nickel (Ni), tin (Sn), and combinations thereof. Moreover, the discussion of Oldham coupling material compositions is also applicable to other components in the scroll compressor or reciprocating compressors, and therefore is not limited to Oldham couplings.

Particularly suitable aluminum alloys comprise greater than or equal to about 79 weight % to less than or equal to about 84 weight % aluminum and optionally further comprise greater than or equal to about 7.5 weight % to less than or equal to about 12 weight % silicon; greater than or equal to about 2 weight % to less than or equal to about 4 weight % copper; greater than or equal to about 1 weight % to less than or equal to about 2 weight % iron, optionally about 1.3 weight % iron; and greater than or equal to about 2.5 weight % to less than or equal to about 3.5 weight % zinc, optionally about 3 weight % zinc.

For example, one particularly suitable aluminum alloy for use in the Oldham coupling 68 is designated as type A380 aluminum alloy (ANSI/AA designation A380.0), which typically comprises greater than or equal to about 7.5 weight % to less than or equal to about 9.5 weight % silicon (nominally about 8.5 wt. % Si); greater than or equal to about 3 weight % to less than or equal to about 4 weight % copper (nominally about 3.5 wt. % Cu); about 3 weight % zinc; about 1.3 weight % iron; about 0.5 weight % manganese; about 0.1 weight % magnesium; about 0.5 weight % nickel; about 0.35 weight % tin; other impurities and diluents at less than or equal to about 0.5 weight %, with a balance of aluminum (ranging from about 80 wt. % to about 83.25 wt. %). Other suitable aluminum alloys include types 383 (ANSI/AA designation 383.0), 384 (ANSI/AA 384.0), 2000 series, 3000 series, 5000 series, 6000 series (e.g., 6061), ADC12 and ADC13. Aluminum alloy type 383 typically comprises greater than or equal to about 9.5 weight % to less than or equal to about 11.5 weight % silicon (nominally about 10.5 wt. % Si); greater than or equal to about 2 weight % to less than or equal to about 3 weight % copper (nominally about 2.5 wt. % Cu); about 3 weight % zinc; about 1.3 weight % iron; about 0.5 weight % manganese; about 0.1 weight % magnesium; about 0.3 weight % nickel; about 0.15 weight % tin; other impurities and diluents at less than or equal to about 0.5 weight %, with a balance of aluminum (ranging from about 79.5 wt. % to about 82.75 wt. %). Aluminum alloy type 384 typically comprises greater than or equal to about 10.5 weight % to less than or equal to about 12 weight % silicon (nominally about 11 wt. % Si); greater than or equal to about 3 weight % to less than or equal to about 4.5 weight % copper (nominally about 3.8 wt. % Cu); about 3 weight % zinc; about 1.3 weight % iron; about 0.5 weight % manganese; about 0.1 weight % magnesium; about 0.5 weight % nickel; about 0.35 weight % tin; other impurities and diluents at less than or equal to about 0.5 weight %, with a balance of aluminum (ranging from about 77.25 wt. % to about 80.25 wt. %). Such aluminum alloys may also be used in the lower bearing 39 in lower bearing assembly 38, by way of non-limiting example.

By way of background, while such aluminum alloys, like type A380, are particularly suitable to form the Oldham coupling 68, because they are lightweight, have relatively good fluidity, pressure tightness, hot strength, and elevated temperature strength, such an alloy may not exhibit sufficient corrosion and/or wear resistance when exposed to a carbon dioxide environment. Particular difficulties arise for Oldham couplings 68 when the refrigerant comprises carbon dioxide. In fact, significant degradation of Oldham couplings made of such aluminum metal alloys can occur in $CO_2$ compressors causing compressor failure. As discussed above, in certain operating regimes, carbon dioxide refrigerant may be subcritical, transcritical or may be in a supercritical state during some operating conditions (e.g., high pressure conditions), where the $CO_2$ is particularly aggressive and corrosive against certain materials. In certain aspects, carbon dioxide behaves as a solvent or corrosive agent and may penetrate a material's surface to cause undesirable adverse reactions, resulting in corrosion, embrittlement, and the like. Propane behaves similarly to carbon dioxide under certain operating conditions, as well. Additionally, conventional refrigerants containing halogens, particularly chlorides, tend to provide greater lubricity between parts. For low global warming potential refrigerants, like carbon dioxide or propane, such lubricity is absent. In certain carbon dioxide scroll machines, the Oldham coupling formed of conventional ferrous-based or aluminum-based metal materials prematurely degrades upon prolonged exposure to carbon dioxide. Particulates and debris can form in the compressor as a result of the degradation that adversely contaminates certain bearings, particularly the lower bearing 39, to reduce bearing and Oldham coupling service lives. Similarly, such degradation can occur in a propane refrigerant environment. This is particularly an issue in hermetic scroll devices, which require long-term durability of all internal components hermetically sealed in the housing shell 12, because maintenance and replacement of Oldham couplings or bearings is typically not an option.

While the metal material of the Oldham coupling 68 for a $CO_2$ refrigerant compressor has previously been surface treated by an anodizing process or electrolytic conversion to create a passivation layer, in certain aspects, such processes may be too expensive, extensive, and/or complicated to form a sufficient robust coating. Furthermore, certain aluminum alloys, like types A380, 383 or 384, form anodized surface coatings having only poor to fair quality when subjected to certain conventional passivation processes. While not limiting the present teachings to any particular theory, it is believed that certain aluminum alloys with particularly high silicon content (by way of non-limiting example silicon present at greater than about 7.5 wt. %) may have potential issues in forming stable high quality passivation layers during anodization suitable to withstand carbon dioxide refrigerant during long-term compressor operation.

To enhance the quality of the passivation layer for carbon dioxide applications, Oldham couplings made of aluminum metal materials were subjected to so-called "hard anodizing," such as disclosed in U.S. Pat. No. 7,811,071, the disclosure of which is hereby incorporated herein by reference in its entirety. Under suitable conditions, such Oldham couplings having hard coat anodization can provide wear resistance allowing for at least 1,000 hours of scroll machine operation. It has been found, however, that achieving a sufficient uniform hard coat anodizing layer may require more complex, extensive, laborious and time-intensive processes to obtain the necessary protection, especially for A-380, A-383, and A-384 aluminum alloys or when the component or part is subjected to significant physical stresses. The present disclosure provides a new anti-wear corrosion protection surface coating applied by a relatively simple and lower cost process that provides a robust, uniform coat having desirable stability in the presence of $CO_2$, as well as necessary wear and friction resistance.

In accordance with various aspects of the present teachings, each wear surface 94 on each Oldham key 88 can be coated with an inventive electroless surface coating 95. Thus, each respective wear surface, including wear surfaces 94, 96, or 98, on the Oldham coupling 68 can be coated with electroless surface coating 95. The electroless surface coating 95 may be applied on only one of or only select wear surfaces of those described. Accordingly, various wear surfaces of the Oldham coupling 68 that may have an electroless surface coating applied, include the entire region of the Oldham keys 88 (or only the terminal contact regions/wear surfaces 94 of keys 88), any surfaces adjacent to the Oldham keys 88, including wear surfaces 96, and the Oldham pads 91 or other regions that may experience contact on Oldham coupling ring 89. As discussed above, these surfaces are subject to wear from being engaged with various other surfaces, including the orbiting scroll 58 and the non-orbiting scroll 70, or thrust bearing surface 56 of main bearing housing 24. Moreover, in certain variations, while not shown, all exposed surfaces of the Oldham coupling 68 may be coated, including the wear surfaces 94, 96, 98 (for example, when the Oldham coupling 68 is immersed in the electroless bath during electroless processing). Any of the compressor components described herein for use with a reciprocating compressor, Oldham couplings, and/or lower bearings comprised of aluminum may have wear surfaces with the electroless coatings described herein.

In certain variations, electroless surface coating depositions according to the present disclosure optionally comprise greater than or equal to about 1% by weight to less than or equal to about 15% by weight phosphorus in the surface coating. The amount of phosphorus present in an electroless surface coating affects the characteristics of the electroless deposition. Phosphorus content of the resultant electroless deposition is dependent on the bath composition and pH value of the electroless bath, where lower pH typically correlates to greater phosphorus content. Generally, electroless depositions having greater than or equal to about 1% by weight to less than or equal to about 3% by weight phosphorus are classified as "low phosphorus"; electroless depositions having greater than or equal to about 4% by weight to less than or equal to about 9% by weight phosphorus are classified as "medium phosphorus"; and electroless depositions having greater than or equal to about 10% by weight to less than or equal to about 13% by weight phosphorus are classified as high phosphorus.

Low phosphorus electroless platings typically provide excellent wear resistance and corrosion resistance. Medium phosphorus electroless platings typically provide good wear resistance and corrosion resistance, while the plating bath is considered to be more economical. High phosphorus electroless platings typically provide good ductility and higher corrosion resistance than low or medium phosphorus electroless platings. While not limiting, in certain aspects, wear surfaces having electroless surface coatings may have medium-weight phosphorous contents, especially for surface coatings comprising nickel and wear resistant particles, like boron nitride. However, an electroless surface coating comprising nickel and wear resistant particles like boron nitride, for example, may have any phosphorus content as described above. In certain variations, electroless surface coatings may have medium- to high-weight phosphorus contents, especially when used to form sublayer platings (e.g., having nickel and phosphorus), but where particles are absent. It should be noted that after applying heat or baking, hardness levels for electroless nickel coatings with low, medium and high phosphorus content levels eventually converge.

In various aspects, the nickel and phosphorus metals in the electroless surface coating can be considered to form a matrix having wear resistant particles distributed therein to form the plated surface coating. The boron nitride particles may be cubic boron nitride (which improves harness) or hexagonal boron nitride (improves lubricity). In particularly certain preferred variations, the wear resistant particle is a hexagonal boron nitride particle. Such wear resistant particles, e.g., boron nitride particles, are co-deposited and occluded within the matrix during the electroless deposition process.

In certain variations, an electroless surface coating comprises greater than or equal to about 3% by weight to less than or equal to about 15% by weight of wear resistant particles in the surface coating; optionally greater than or equal to about 4% by weight to less than or equal to about 10% by weight; and in certain variations, optionally greater than or equal to about 5% by weight to less than or equal to about 8% by weight of wear resistant particles in the surface coating. In certain variations, an electroless surface coating comprises greater than or equal to about 3% by weight to less than or equal to about 15% by weight of boron nitride particles in the surface coating; optionally greater than or equal to about 4% by weight to less than or equal to about 10% by weight; and in certain variations, optionally greater than or equal to about 5% by weight to less than or equal to about 8% by weight of boron nitride particles in the surface coating.

By way of example, one particularly suitable electroless surface coating for use in accordance with the present disclosure comprises phosphorous at greater than or equal to about 4% by weight to less than or equal to about 6% by weight of the electroless surface coating and boron nitride particles (e.g., hexagonal boron nitride) at greater than or equal to about 6% by weight to less than or equal to about 8% by weight of the electroless surface coating, where a balance of the surface coating is nickel.

In addition to or substituted for phosphorous and/or boron nitride, in certain alternative variations, electroless coatings comprising nickel may include additional additives that can further enhance certain properties of the coating.

The present disclosure contemplates creating multiple layers of electroless surface coatings in conjunction with one another. In certain circumstances, a first electroless surface coating may be used as a tie layer or sublayer between the aluminum surface and subsequently deposited layers. For example, a first electroless surface coating sublayer may comprise nickel and phosphorus, for example, having a low-weight, medium-weight or high-weight phosphorous layer. In certain aspects, a medium-weight or high-weight phosphorous sublayer may be used. In certain variations, the sublayer of electroless nickel comprises phosphorous at greater than or equal to about 1% by weight to less than or equal to about 20% by weight of the overall sublayer; optionally greater than or equal to about 3% by weight to less than or equal to about 15% by weight of the overall sublayer. According to other embodiments, an additional tie layer or sublayer may be used, such as one comprising zinc, like zincate, phosphoric acid anodization, ammonium fluoride, and/or stannate may be used to improve the adhesion between an aluminum substrate and an electroless surface coating.

A second electroless surface coating may be electrolessly deposited over the first sublayer. The second electroless surface coating may comprise nickel, phosphorus, and boron nitride, or be any of the other variations discussed in the context of the present teachings.

In certain variations, the electroless surface coatings of the present disclosure have a hardness as deposited of greater than or equal to about 40 to less than or equal to about 63 on a Rockwell C Hardness Scale (HRC), optionally greater than or equal to about 47 to less than or equal to about 63 on a Rockwell C Hardness Scale (HRC), and optionally greater than or equal to about 50 to less than or equal to about 63 in certain variations. In certain aspects, hardness of an as-deposited electroless surface coating can be increased by heat treatment and annealing. Post-plating heat treatments (e.g., subjecting the plated part to high temperatures) can increase hardness to greater than or equal to about 72 HRC.

Without annealing, an electroless surface coating comprising nickel, phosphorus, and boron nitride particles, as initially deposited on a surface, generally has a representative hardness of greater than or equal to about 41 to less than or equal to about 44 HRC. Once annealed at the exemplary times and temperatures discussed herein, the same electroless surface coating optionally has a hardness of greater than or equal to about 40 to less than or equal to about 63 HRC, optionally greater than or equal to about 50 to less than or equal to about 63 HRC, optionally greater than or equal to about 52 to less than or equal to about 55 HRC in certain embodiments. Likewise, an electroless sublayer comprising nickel and phosphorus may have a hardness of greater than or equal to about 40 to less than or equal to about 55 HRC, optionally greater than or equal to about 50 to less than or equal to about 55 HRC. Once annealed, the electroless sublayer has a hardness of greater than or equal to about 57 to less than or equal to about 63 HRC.

In certain aspects, the present disclosure provides a method of making an anti-friction protective coating for a wear surface of a carbon dioxide compressor machine component comprising aluminum that comprises first electrolessly coating at least one wear surface of the component. In certain variations, the method further comprises heat treating by exposing the electroless surface coating to a temperature of greater than or equal to about 650° F. (343° C.) to less than or equal to about 700° F. (371° C.) for a duration of greater than or equal to about 1 hour. In certain aspects, a particularly suitable temperature for annealing is about 660° F. (349° C.). After the heat treating, the electroless surface coating may have a hardness of greater than or equal to about 57 HRC. In certain aspects, after the heat treating, the electroless surface coating has a hardness of greater than or equal to about 57 to less than or equal to about 63 HRC.

In various aspects, the at least one wear surface is fully coated by the electroless surface coating layer, having an uneven deposition density and no uneven build-up of coating, pin holes or chipped regions. In certain variations, the electroless surface coating is deposited at a thickness of greater than or equal to about 0.0005 inches (about 12.7 micrometers or μm) to less than or equal to about 0.001 inches (about 25 μm). If an optional sublayer is present, the sublayer may be deposited to a thickness of greater than or equal to about 0.002 inches (about 51 μm) to less than or equal to about 0.0025 inches (about 64 μm). Thus, an overall thickness of an electroless surface coating comprising a topcoat and sublayer may be greater than or equal to about 0.0025 inches (about 64 μm) to less than or equal to about 0.0035 inches (about 89 μm), in certain variations.

By way of example, an electroless coating layer is disposed directly onto a wear surface of compressor component made from an aluminum alloy. The electroless coating layer may have a thickness of greater than or equal to about 0.0005 inches to less than or equal to about 0.001 inches. The electroless coating layer optionally comprises greater than or equal to about 6% by weight to less than or equal to about 8% by weight of occluded boron nitride particles and from greater than or equal to about 4% by weight to less than or equal to about 8% by weight phosphorous. Multiple layers of the electroless coating having the same or similar composition may be applied to the surface, as well.

In certain other variations, a suitable electroless surface coating on a wear surface of a compressor component made from an aluminum alloy may comprise a plurality of layers. For example, in one embodiment, a first layer is a base layer or sublayer having a thickness of greater than or equal to about 0.002 inches to less than or equal to about 0.0025 inches of an electroless surface coating, where the sublayer may have greater than or equal to about 5% by weight to less than or equal to about 15% by weight phosphorus content. A second electroless coating layer is then disposed over the sublayer and has a thickness of greater than or equal to about 0.0005 inches to less than or equal to about 0.001 inches. The second electroless coating layer optionally comprises greater than or equal to about 6% by weight to less than or equal to about 8% by weight of occluded boron nitride particles and from greater than or equal to about 4% by weight to less than or equal to about 8% by weight phosphorous.

One suitable process for electroless plating of nickel, phosphorus, and boron nitride is the Millenium KR™ process, commercially available from Erie Hard Chrome, Inc. (Erie, Pa.). Other similar electroless nickel plating systems are commercially available from US Plating & Surface Finishing (Kansas City, Mo.), Monroe Plating (Rochester, N.Y.) and Compound Metal Coatings, Inc., Mississauga, ON, Canada.

While not limiting the present teachings to any particular processes or process conditions, the following electroless deposition process is provided for purposes of illustration and is merely exemplary. As appreciated by those of skill in the art, various electroless bath compositions and different conditions may be selected. Therefore, an exemplary process for electrolessly applied nickel and boron nitride particle coating to an aluminum alloy may use sodium hypophosphite as a reducing agent. An exemplary and non-limiting bath can have a pH of about 4 and a temperature of greater than or equal to about 85° C. (185° F.) to less than or equal to about 90° C. (194° F.). Another suitable electrolessly applied nickel boron nitride coating process comprises providing an aluminum substrate, immersing the substrate in a bath wherein the bath comprises a solution of nickel and boron nitride, and leaving the aluminum substrate in the bath for a predetermined period of time. Different parameters may be used in order to achieve varying characteristics. For instance, as discussed above, where increased hardness is desired, annealing may be utilized with electrolessly deposited nickel and boron nitride layers having phosphorous.

In other embodiments, the aluminum substrate may be subjected to a first bath comprising a nickel solution and optionally a nickel phosphorous solution. In several embodiments, the aluminum substrate is machined, pretreated, and/or cleaned prior to being subjected to either the nickel boron nitride bath or nickel bath, as the case may be. For example, the aluminum substrate may further be cleaned prior to being subjected to either the nickel boron nitride bath or nickel bath. The cleaning may comprise a caustic cleaning operation. Any of the compressor components described herein for use with a reciprocating compressor, Oldham couplings, and/or lower bearings comprised of aluminum may have a coating in accordance with the inventive technology.

Therefore, the present disclosure provides methods of making an anti-friction electroless surface coating for a wear surface of a carbon dioxide compressor machine component or alternatively for a wear surface of a propane compressor machine component. The method optionally comprises electrolessly coating at least one wear surface of an aluminum compressor component by contacting the at least one wear surface with an electroless bath comprising nickel, phosphorus, and wear resistant particles, such as boron nitride particles, to form an electroless surface coating. The electroless surface coating thus formed may have a hardness of greater than or equal to about 40 to less than or equal to about 63 on a Rockwell C Hardness Scale. The aluminum compressor component having the at least one wear surface comprising the electroless surface coating is capable of withstanding at least greater than or equal to about 1,000 hours of operation in a carbon dioxide compressor machine that processes a refrigerant comprising carbon dioxide. In certain aspects, the aluminum compressor component having the electroless surface coating is capable of withstanding at least greater than or equal to about 1,500 hours of scroll machine operation, preferably at least greater than or equal to about 2,000 hours or longer of scroll machine operation/service processing a refrigerant comprising carbon dioxide.

In other alternative variations, the aluminum compressor component having the at least one wear surface comprising the electroless surface coating is capable of withstanding at least greater than or equal to about 1,000 hours of operation in a propane compressor machine that processes a refrigerant comprising propane. In certain aspects, the aluminum compressor component having the electroless surface coating is capable of withstanding at least greater than or equal to about 1,500 hours of scroll machine operation, preferably at least greater than or equal to about 2,000 hours or longer of scroll machine operation/service processing a refrigerant comprising propane.

Another measure of compressor component longevity is to quantify compressor coefficient of performance (COP) in a refrigeration system, which generally indicates the efficiency of the compressor. As internal components potentially degrade in their performance the COP will likewise be reduced. The COP is usually defined as a ratio of the heating capacity of the compressor/system ($Q_{in}$ or the enthalpy entering the system) to the work/electric power consumption of the compressor (and in some cases also the power consumption of the fan). Thus, COP is generally defined as the heating capacity of the system divided by the power input to the system and can be a useful measure of the compressor's performance. In various aspects, the performance of a compressor has a COP loss defined by $$\Delta COP\ (\%) = \frac{(COP_{initial} - COP_{final})}{COP_{initial}} \times 100,$$

where $COP_{initial}$ is an initial COP measured at the beginning of compressor operation and $COP_{final}$ is compressor performance at the end of a reliability test. In certain aspects, the performance of a compressor having the electroless surface coating on a wear surface of the compressor component has a COP loss of less than or equal to about 5% over 1,000 hours of compressor performance; optionally less than or equal to about 4% change in COP over 1,000 hours of compressor performance; optionally less than or equal to about 3% change in COP over 1,000 hours of compressor performance. In certain aspects, the compressor has a COP loss of less than or equal to about 5% change in COP over 1,500 hours of compressor performance; optionally less than or equal to about 4% change in COP over 1,500 hours of compressor performance; and in certain aspects, optionally less than or equal to about 3% change in COP over 1,500 hours of compressor performance. In certain aspects, the compressor has a COP loss of optionally less than or equal to about 5% change in COP over 2,000 hours of compressor performance; optionally less than or equal to about 4% change in COP over 2,000 hours of compressor performance.

The methods of the present disclosure may further include those where two distinct electroless baths are used in sequence to form a sublayer and a top surface coating. Thus, in such variations, the at least one wear surface is first contacted with a first electroless bath comprising nickel and phosphorus to form an electroless nickel sublayer over the at least one wear surface. This is followed by exposing the at least one wear surface to the second electroless bath comprising nickel, phosphorus, and wear resistant particles, e.g., boron nitride particles to form the electroless surface coating over the electroless nickel sublayer.

In other aspects, the methods of the present disclosure further comprise heat treating by exposing the electroless surface coating to a temperature of greater than or equal to about 650° F. to less than or equal to about 700° F. for a duration of greater than or equal to about 1 hour. After the heat treating, the electroless surface coating may have a hardness of greater than or equal to about 57 to less than or equal to about 63 on a Rockwell C Hardness Scale.

In yet other aspects, the methods of the present disclosure may include conducting the electroless coating process until the electroless surface coating comprising nickel and boron nitride particles (and optionally phosphorus) has a thickness of greater than or equal to about 0.0005 inches to less than or equal to about 0.001 inches. In certain aspects, the electroless surface coating comprises greater than or equal to about 6% by weight to less than or equal to about 8% by weight of boron nitride particles, greater than or equal to about 4% by weight to less than or equal to about 8% by weight phosphorus, and a balance of nickel.

For reasons similar to the problems posed by Oldham couplings used in scroll compressors comprising carbon dioxide refrigerants or alternatively propane refrigerants, it is further envisioned that the electroless surface coatings of the present disclosure may be used with compressor parts comprising aluminum in other types of compressor machines, such as reciprocating compressors. In other embodiments, therefore, a reciprocating compressor is provided. By way of example, the exemplary hermetically sealed reciprocating compressor 100 in FIG. 5 can be of the type disclosed in assignee's U.S. Patent Pub. No. 2004/0202562 to Grassbaugh, the disclosure of which is hereby incorporated by reference. The reciprocating compressor 100 includes a sealed casing 112 including a lower shell 114 and an upper shell 116 sealingly connected to one another. A suction inlet passage 117 is provided in the sealed casing 112. A motor 118 is disposed within the casing 112 and includes a rotor (not shown), a stator 120, and a crank shaft 122, which is connected to the rotor, as known in the art. The crank shaft 122 includes an eccentric portion 124.

The motor 118 includes a motor cover 125. A uni-body member 126 is mounted to the motor 118. The uni-body member 126 includes a body portion 128 defining a cylinder 130 and a bell-shaped housing portion 132. A head portion 134 is formed as a unitary piece with the body 128 and includes a first discharge cavity 136A in communication with the cylinder 130, and a second discharge cavity 136B is in communication with the first discharge cavity 136A via a restriction 136C. The size of the first and second discharge chambers 136A, 136B are preferably sized to optimize discharge pulse or efficiency. Further, the restriction 136C can be sized or provided with an insert to further optimize the discharge pulse. A discharge tube 101 is connected to the outlet port 102 of the second discharge chamber 136B. Preferably, the discharge tube 101 has a snap-fit engagement with the outlet port 102. Specifically, the discharge tube 101 can be provided with a tube fitting (not shown) with a radially expanding retainer ring (not shown) which upon being pushed through the outlet port 102 expands outward, preventing the tube fitting from being removed or blown out. A compliant seal member (not shown) forms a generally gas-tight seal between outlet port 102 and tube fitting. A muffler 108 can optionally be provided in the discharge tube passage 101. The discharge tube 101 is connected to a discharge port 110 provided in the sealed casing 112.

A piston 138 is disposed within the cylinder 130 and is connected to a connecting rod 140, which is connected to the eccentric portion 124 of the crank shaft 122. A suction passage 142 is provided in the uni-body member 126 and communicates with the cylinder 130 and a hollow section 144 defined by the bell-shaped portion 132 of the body 128. The piston 138 is generally cylindrical in shape and translates in cylinder 130. It is envisioned that parts in the reciprocating compressor comprising aluminum and defining wear surfaces, such as the piston 138 and connecting rod 140, may define wear surface regions 150 that may also have the electroless surface coating according to the present disclosure.

All possible combinations discussed and enumerated above and herein as optional features of the inventive materials and inventive methods of the present disclosure are specifically disclosed as embodiments. In various aspects, the present disclosure contemplates a compressor comprising a compressor component comprising aluminum and having at least one wear surface with an electroless surface coating comprising nickel. The electroless surface coating may have a hardness of greater than or equal to about 40 to less than or equal to about 63 on a Rockwell C Hardness Scale. In certain variations, the compressor is configured to process a refrigerant comprising carbon dioxide. In other variations, the compressor is configured to process a refrigerant comprising propane. In certain aspects, the compressor component having the at least one wear surface with the electroless surface coating is capable of use for at least greater than or equal to about 1,000 hours of compressor operation. Also specifically disclosed are combinations including this compressor comprising a compressor component optionally with any one or any combination of more than one of the enumerated features (1)-(12).

The compressor of the first embodiment optionally has any one or any combination of more than one of the following features: (1) the compressor is a scroll compressor further comprising a first scroll member having a discharge port and a first spiral wrap; a second scroll member having a second spiral wrap, the first and second spiral wraps being mutually intermeshed; a motor for causing the second scroll member to orbit with respect to the first scroll member; and the compressor component having the at least one wear surface with the electroless surface is an Oldham coupling keyed to the second scroll member and another component to prevent rotational movement of the second scroll member; (2) the compressor is a scroll compressor further comprising a first scroll member having a discharge port and a first spiral wrap; a second scroll member having a second spiral wrap, the first and second spiral wraps being mutually intermeshed; a motor for causing the second scroll member to orbit with respect to the first scroll member; and a lower bearing mounted to a terminal end of the shaft opposite to the second scroll member, wherein the compressor component having the at least one wear surface with the electroless surface coating is the lower bearing; (3) the compressor is a reciprocating compressor further comprising a motor and a crank shaft; a piston drivingly connected to the crank shaft with a connecting rod; a uni-body member including a body portion defining a cylinder for receiving the piston for reciprocating movement therein and a head portion defining a discharge passage in communication with the cylinder; and wherein the compressor component having the at least one wear surface with the electroless surface coating is selected from a group consisting of the piston, the cylinder, the connecting rod, and combinations thereof; (4) the electroless surface coating further comprises a wear resistance particle selected from a group consisting of: boron nitride, silicon carbide, titanium carbonitride, titanium nitride, diamond, polytetrafluoroethylene, and combinations thereof; (5) the electroless surface coating further comprises a boron nitride particle; (6) the boron nitride particle comprises a cubic boron nitride or a hexagonal boron nitride; (7) the compressor comprising the compressor component having the at least one wear surface with the electroless surface coating provides less than or equal to about 5% loss of coefficient of performance (COP) over 1,000 hours of compressor operation; (8) the electroless surface coating further comprises a boron nitride particle and the at least one wear surface of the compressor component further comprises a sublayer of electroless nickel disposed beneath the electroless surface coating; (9) the sublayer of electroless nickel comprises phosphorous at greater than or equal to about 5% by weight to less than or equal to about 15% by weight of the sublayer and has a thickness of greater than or equal to about 0.002 inches to less than or equal to about 0.0025 inches; (10) the electroless surface coating has a thickness of greater than or equal to about 0.0005 inches to less than or equal to about 0.001 inches; (11) the electroless surface coating further comprises phosphorous at greater than or equal to about 4% by weight to less than or equal to about 6% by weight of the electroless surface coating and boron nitride particles at greater than or equal to about 6% by weight to less than or equal to about 8% by weight of the electroless surface coating, and a balance of nickel, wherein the nickel and the phosphorous define a matrix having the boron nitride particles distributed therein; and/or (12) the compressor component comprises an aluminum alloy selected from a group consisting of: A-380 aluminum alloy, A-383 aluminum alloy, and combinations thereof.

In other aspects, the present disclosure contemplates a scroll machine comprising a first scroll member having a discharge port and a first spiral wrap and a second scroll member having a second spiral wrap, wherein the first and second spiral wraps are mutually intermeshed. The scroll compressor further comprises a motor for causing the second scroll member to orbit with respect to the first scroll member, wherein the scroll machine is configured to process a refrigerant comprising one of carbon dioxide and propane. The scroll machine further comprises an Oldham coupling keyed to the second scroll member and another component to prevent rotational movement of the second scroll member, wherein the Oldham coupling comprises aluminum and has at least one wear surface comprising an electroless surface coating comprising nickel and a wear resistant particle. Also specifically disclosed are combinations including this compressor comprising a compressor component optionally with any one or any combination of more than one of the enumerated features (13)-(21).

The scroll machine having the Oldham coupling according to this embodiment optionally has any one or any combination of more than one of the following features: (13) the wear resistant particle is selected from a group consisting of: boron nitride, silicon carbide, titanium carbonitride, titanium nitride, diamond, polytetrafluoroethylene, and combinations thereof; (14) the wear resistant particle comprises boron nitride; (15) the boron nitride particle is a cubic boron nitride or a hexagonal boron nitride; (16) the electroless surface coating comprises greater than or equal to about 6% by weight to less than or equal to about 8% by weight of the boron nitride particles in the surface coating; (17) the Oldham coupling comprises an aluminum alloy selected from a group consisting of: A-380 aluminum alloy, A-383 aluminum alloy, and combinations thereof; (18) the electroless surface coating has a thickness of greater than or equal to about 0.0005 inches to less than or equal to about 0.001 inches; (19) the wear resistant particle comprises boron nitride and the electroless surface coating further comprises phosphorous at greater than or equal to about 4% by weight to less than or equal to about 6% by weight of the surface coating, wherein the nickel and the phosphorus define a matrix having the boron nitride particles distributed therein; (20) the electroless surface coating has a hardness of greater than or equal to about 40 to less than or equal to about 63 on a Rockwell C Hardness Scale; (21) the at least one wear surface further comprises a sublayer of electroless nickel disposed beneath the electroless surface coating having a thickness of greater than or equal to about 0.002 inches to less than or equal to about 0.0025 inches; and/or (22) the sublayer of electroless nickel further comprises phosphorous at greater than or equal to about 5% by weight to less than or equal to about 15% by weight of the sublayer.

In yet other aspects, the present disclosure contemplates a method for forming an anti-friction coating for a wear surface of a compressor machine component. The method comprises electrolessly coating at least one wear surface of an aluminum compressor component by contacting the at least one wear surface with an electroless bath comprising nickel, phosphorous, and a wear resistant particle selected from a group consisting of: boron nitride, silicon carbide, titanium carbonitride, titanium nitride, diamond, polytetrafluoroethylene, and combinations thereof. The wear surface has a hardness of greater than or equal to about 40 to less than or equal to about 63 on a Rockwell C Hardness Scale. The aluminum compressor component having the at least one wear surface comprising the electroless surface coating is capable of withstanding at least greater than or equal to about 1,000 hours of operation in a compressor machine that processes a refrigerant comprising carbon dioxide and/or propane.

Also specifically disclosed are combinations including this method optionally with any one or any combination of more than one of the enumerated steps or features (23)-(26). The method for electrolessly coating at least one wear surface of an aluminum compressor coating optionally has any one or any combination of more than one of the following steps or features: (23) first contacting at least one wear surface to a second electroless bath comprising nickel and phosphorous to form an electroless nickel sublayer over the at least one wear surface, followed by contacting the at least one wear surface to the first electroless bath comprising nickel, phosphorous, and wear resistant particles to form the electroless surface coating over the electroless nickel sublayer; (24) further comprising heat treating by exposing the electroless surface coating to a temperature of greater than or equal to about 650° F. to less than or equal to about 700° F. for a duration of greater than or equal to about 1 hour, wherein after the heat treating, the electroless surface coating has a hardness of greater than or equal to about 57 to less than or equal to about 63 on a Rockwell C Hardness Scale; (25) conducting the coating of the electrolessly applied coating until the electroless surface coating has a thickness of greater than or equal to about 0.0005 inches to less than or equal to about 0.001 inches; and/or (26) the wear resistant particle comprising boron nitride and the electroless surface coating comprises greater than or equal to about 6% by weight to less than or equal to about 8% by weight of the boron nitride particle, greater than or equal to about 4% by weight to less than or equal to about 8% by weight of the phosphorous, and a balance of nickel.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a compressor component having at least one wear surface comprising aluminum with an electroless surface coating comprising nickel disposed directly thereon, the electroless surface coating having a hardness of greater than or equal to about 40 to less than or equal to about 63 on a Rockwell C Hardness Scale, wherein the compressor is configured to process a refrigerant selected from the group: carbon dioxide, propane, and combinations thereof, wherein the compressor component having the at least one wear surface with the electroless surface coating withstands greater than or equal to about 1,000 hours of compressor operation.

2. The compressor of claim 1, wherein the compressor is a scroll compressor further comprising:

a first scroll member having a discharge port and a first spiral wrap;

a second scroll member having a second spiral wrap, the first and second spiral wraps being mutually intermeshed; and a motor for causing the second scroll member to orbit with respect to the first scroll member, wherein the compressor component having the at least one wear surface with the electroless surface coating is an Oldham coupling keyed to the second scroll member and another component to prevent rotational movement of the second scroll member.

3. The compressor of claim 1, wherein the compressor is a scroll compressor further comprising:

a first scroll member having a discharge port and a first spiral wrap;

a second scroll member having a second spiral wrap, the first and second spiral wraps being mutually intermeshed;

a motor for rotating a shaft that causes the second scroll member to orbit with respect to the first scroll member; and a lower bearing mounted to a terminal end of the shaft opposite to the second scroll member, wherein the compressor component having the at least one wear surface with the electroless surface coating is the lower bearing.

4. The compressor of claim 1, wherein the compressor is a reciprocating compressor, further comprising:

a motor and a crank shaft;

a piston drivingly connected to the crank shaft with a connecting rod; and a uni-body member including a body portion defining a cylinder for receiving the piston for reciprocating movement therein and a head portion defining a discharge passage in communication with the cylinder, and the compressor component having the at least one wear surface with the electroless surface coating is selected from the group consisting of: the piston, the cylinder, the connecting rod, and combinations thereof.

5. The compressor of claim 1, wherein the electroless surface coating further comprises a wear resistance particle selected from the group consisting of: boron nitride, silicon carbide, titanium carbonitride, titanium nitride, diamond, polytetrafluoroethylene, and combinations thereof.

6. The compressor of claim 1, wherein the electroless surface coating further comprises a cubic boron nitride particle or a hexagonal boron nitride particle.

7. The compressor of claim 1, wherein the compressor comprising the compressor component having the at least one wear surface with the electroless surface coating provides less than or equal to about 5% loss of coefficient of performance (COP) over 1,000 hours of compressor operation.

8. The compressor of claim 1, wherein the electroless surface coating further comprises phosphorous at greater than or equal to about 4% by weight to less than or equal to about 6% by weight of the electroless surface coating, boron nitride particles at greater than or equal to about 6% by weight to less than or equal to about 8% by weight of the electroless surface coating, and a balance of nickel, wherein the nickel and the phosphorus define a matrix having the boron nitride particles distributed therein.

9. The compressor of claim 1, wherein the compressor component comprises an aluminum alloy selected from the group consisting of: A-380 aluminum alloy, A-383 aluminum alloy, and combinations thereof.

10. A scroll machine comprising:

a first scroll member having a discharge port and a first spiral wrap;

a second scroll member having a second spiral wrap, the first and second spiral wraps being mutually intermeshed;

a motor for causing the second scroll member to orbit with respect to the first scroll member, wherein the scroll machine is configured to process a refrigerant selected from the group: carbon dioxide, propane, and combinations thereof; and an Oldham coupling keyed to the second scroll member and another component to prevent rotational movement of the second scroll member, wherein the Oldham coupling has at least one wear surface comprising aluminum with an electroless surface coating comprising nickel and a wear resistant particle disposed directly thereon.

11. The scroll machine of claim 10, wherein the wear resistant particle is selected from the group consisting of:

boron nitride, silicon carbide, titanium carbonitride, titanium nitride, diamond, polytetrafluoroethylene, and combinations thereof.

12. The scroll machine of claim 10, wherein the wear resistant particle comprises a cubic boron nitride particle or a hexagonal boron nitride particle.

13. The scroll machine of claim 12, wherein the electroless surface coating comprises greater than or equal to about 6% by weight to less than or equal to about 8% by weight of the wear resistant particle comprising the cubic boron nitride particle or the hexagonal boron nitride particle in the surface coating.

14. The scroll machine of claim 10, wherein the Oldham coupling comprises an aluminum alloy selected from the group consisting of: A-380 aluminum alloy, A-383 aluminum alloy, and combinations thereof.

15. The scroll machine of claim 10, wherein the wear resistant particle comprises boron nitride and the electroless surface coating further comprises phosphorous at greater than or equal to about 4% by weight to less than or equal to about 6% by weight of the surface coating, wherein the nickel and the phosphorus define a matrix having the boron nitride particles distributed therein.

16. The scroll machine of claim 10, wherein the electroless surface coating has a hardness of greater than or equal to about 40 to less than or equal to about 63 on a Rockwell C Hardness Scale.

17. A compressor comprising:

a compressor component having at least one wear surface comprising aluminum with an electroless surface coating comprising nickel disposed directly thereon, the electroless surface coating comprising multiple layers including a first layer comprising nickel and a boron nitride particle and a second layer that is a sublayer of electroless nickel disposed beneath the first layer, wherein the electroless surface coating has a hardness of greater than or equal to about 40 to less than or equal to about 63 on a Rockwell C Hardness Scale, wherein the compressor is configured to process a refrigerant selected from the group: carbon dioxide, propane, and combinations thereof, wherein the compressor component having the at least one wear surface with the electroless surface coating withstands greater than or equal to about 1,000 hours of compressor operation.

18. The compressor of claim 17, wherein the second layer comprises phosphorous at greater than or equal to about 5% by weight to less than or equal to about 15% by weight of the second layer and has a thickness of greater than or equal to about 0.002 inches to less than or equal to about 0.0025 inches.

19. A scroll machine comprising:

a first scroll member having a discharge port and a first spiral wrap;

a second scroll member having a second spiral wrap, the first and second spiral wraps being mutually intermeshed;

a motor for causing the second scroll member to orbit with respect to the first scroll member, wherein the scroll machine is configured to process a refrigerant selected from the group: carbon dioxide, propane, and combinations thereof; and an Oldham coupling keyed to the second scroll member and another component to prevent rotational movement of the second scroll member, wherein the Oldham coupling has at least one wear surface comprising aluminum with an electroless surface coating comprising multiple layers including a first layer comprising nickel and a wear resistant particle and a second layer comprising electroless nickel disposed beneath the first layer.

20. The scroll machine of claim 19, wherein the first layer has a thickness of greater than or equal to about 0.002 inches to less than or equal to about 0.0025 inches.

21. The scroll machine of claim 19, wherein the second layer of electroless nickel further comprises phosphorous at greater than or equal to about 5% by weight to less than or equal to about 15% by weight of the second layer.

* * * * *